United States Patent [19]

Saiki et al.

[11] Patent Number: 4,693,173

[45] Date of Patent: Sep. 15, 1987

[54] CLEAN ROOM

[75] Inventors: Atsushi Saiki, Koganei; Michio Suzuki, Hino; Hideo Sunami, Nishitama; Shojiro Asai, Tsukui; Michiyoshi Maki, Hachioji; Kinichiro Asami, Niiza, all of Japan

[73] Assignees: Hitachi Plant Engineering & Construction Co., Ltd.; Hitachi, Ltd., both of Tokyo, Japan

[21] Appl. No.: 786,550

[22] Filed: Oct. 11, 1985

[30] Foreign Application Priority Data

Oct. 11, 1984 [JP] Japan ..... 59-211376
Oct. 11, 1984 [JP] Japan ..... 59-211375

[51] Int. Cl.[4] ..... F24F 9/00

[52] U.S. Cl. ..... 98/31.5; 55/385 A; 98/40.1; 98/42.02

[58] Field of Search ..... 98/31.5, 31.6, 33.1, 98/34.5, 34.6, 36, 42.02, 115.3, 40.1; 55/385 A

[56] References Cited

U.S. PATENT DOCUMENTS 3,367,257 2/1968 Raider et al. ..... 98/34.5 X
3,986,850 10/1976 Wilcox ..... 98/40.11 X
4,549,472 10/1985 Endo et al. ..... 98/31.5 X

FOREIGN PATENT DOCUMENTS 182046 10/1983 Japan ..... 98/36
391357 12/1973 U.S.S.R. ..... 98/36

*Primary Examiner*—Harold Joyce
*Attorney, Agent, or Firm*—Antonelli, Terry & Wands

[57] ABSTRACT

A clean room wherein clean air obtained through filters from the upper portion of the clean room is blown toward the floor, through the openings in the floor, and with the clean air being discharged again through the filters from the upper portion of the clean room. The air flow rate of clean air in the aisle areas is greater than the air flow rate in the wafer handling areas, and the opening rate of the floor is smaller in the portion near to an air return under the floor than in the portion remote from the air return thereby greatly reducing the diffusion of dust to the wafer handling areas.

15 Claims, 19 Drawing Figures

CLEAN ROOM

BACKGROUND OF THE INVENTION

The present invention relates to a clean room and, more particularly, to a clean room in which dust generated in other areas do not diffuse into the areas which must be kept clean.

In the semiconductor industry, the cleanliness requirement for a clean room has been becoming severer from year to year, and a so-called superclean room or superclean space has become necessary as the integration has grown to 64K, 256K and further 1M bits, as represented by MOS memory devices. As a construction proposed as a clean room to realize such superclean space, for instance, there is a down flow type wherein HEPA (High Efficiency Particulate Air) filters are provided over the whole ceiling and the floor is covered with floor boards shaped in a lattice or having many holes and clean air is blown out from the above filters vertically to the floor, as described in "Electonic Material" of August 1983, pages 51–56, or a clean room so-called a tunnel module type or a bay type wherein the wafer handling area is centrally made superclean and the aisles and the maintainance area around it are made to keep normal cleanliness, as described in the above reference and "Nikkei Electronics Microdevice", pages 134–138 (Aug. 22, 1983), a separate volume of "Nikkei Electronics".

In spite of wearing a clean garment, the greatest source of generating dust is the operator, and a considerable quantity of dust is generated when the operators are moving. Accordingly, dust is always generated in the aisle areas, and the dust diffuses into the wafer handling areas which must be maintained extremely clean manufacturing, with the dust adhering to the products, thereby lowering the yield rate or reliability of the products. Furthermore, when the distribution of air flow was measured in regard to down flow type, it was determined that a down flow was not always formed for reasons set forth more clearly hereinbelow.

Moreover, since the prior art clean room, called a tunnel module type, or bay type is the one which is divided into many partitions to locally clean the wafer handling areas, its running cost is small, but is disadvantagous in that the layout cannot be changed freely and large-scaled reconstruction is required to make a change such as renewal or replacement of the facilities, and this requires a huge expense.

The object of the present invetion resides in avoiding the problems encountered in the prior art and to provide a clean room in which diffusion of dust from the areas where dust is easily generated to the areas to be kept clean is extremely small.

A further object of the present invention is to provide a clean room which can produce a superclean space having small dust diffusion, by making the air flow substantially down flow in a clean room having a ceiling provided with filters substantially over the wohole surface thereof and having a floor covered with a lattice-shaped floor board with openings over the whole surface thereof and designed to be a down flow type.

A still further object of the present invention is to provide an arrangement for a clean room which reduces diffusion of dust, generated in the aisle areas into the wafer handling areas by making the air in the wafer handling areas attracted to the aisle areas.

According to the clean room of the present invention clean, air is drawn from the upper portion of the clean room into the floor of the clean room through the filters provided, for example, in the ceiling of the clean room and is discharged through the openings in the floor and is again drawn into the floor of the clean room from the upper portion of the clean room through the filters. An opening rate above the floor is smaller in a portion near to the air return under the floor than in a portion remote from the air return under the floor, and/or the air flow rate of the clean air in the aisle areas is larger than that in the wafer handling areas.

Although the above noted features are effective when they are respectively used alone, more excellent effect can be obtained if both are provided.

To provide for an opening rate, the present invention cancels the air flow convergence upon the floor openings in a specific portion, for example by differing or varying the opening rate of a lattice-shaped floor board specific places. The is, the opening rate is made smaller for the floor board near to the under-floor air return, and the opening rate is made larger for the floor board a place farther from the return. By this arrangement it is possible to avoid the above disadvantage that down flow cannot be obtained, and also possible to realize a clean room where air flow is substantially down flow. The opening rate of the side nearest to the air return is preferably 20% or less, and if the opening rate of the place remote from the return is even a little larger than 20%, an effect to that extent can be obtained.

With regard to controlling the clean air flow rate, according to the present invention different air flow rates are provided in dependence upon the charateristics of the areas, so that the air flow rate in the aisle areas where dust is easily generated in larger than the air flow rate in the wafer handling areas which should be kept clean thereby reducing the diffusion of the dust generated in the aisle areas into the wafer handling areas, and to provide a clean room where the dust in the wafer handling areas are extremely few.

Generally, in most cases, the air flow rate in the wafer handling areas is set to be about 0.35 m/s, but the air flow rate can also be set to about 0.25–0.50 m/s, and even beyond this if the atmosphere of clean air can be maintained. If the air flow rate in the aisle areas is even a little greater than the air flow rate in the wafer handling areas, an effect to that extent can be obtained, but the air flow rate of the aisle areas providing a more preferable result is, for example, 0.50–0.70 m/s if the air flow rate in the wafer handling areas is 0.25 m/s, 0.50–1.00 m/s, if the air flow rate in the wafer handling areas is 0.35 m/s, and 0.70–1.00 m/s, if the air flow rate in the handling area is 0.50 m/s. In addition, if the air flow rate in the wafer handling areas is around 0.35 m/s and the air flow rate in the aisle areas is around 0.70 m/s, the most preferable result can be obtained. If the air flow rate in the aisle areas is lower, the effect of the present invention will be small, and if higher, the cost will rise. The air flow rate can be changed by controlling the fan units.

The air flow rate can be changed by controlling the fan units.

DETAILED DESCRIPTION

Figure 1:
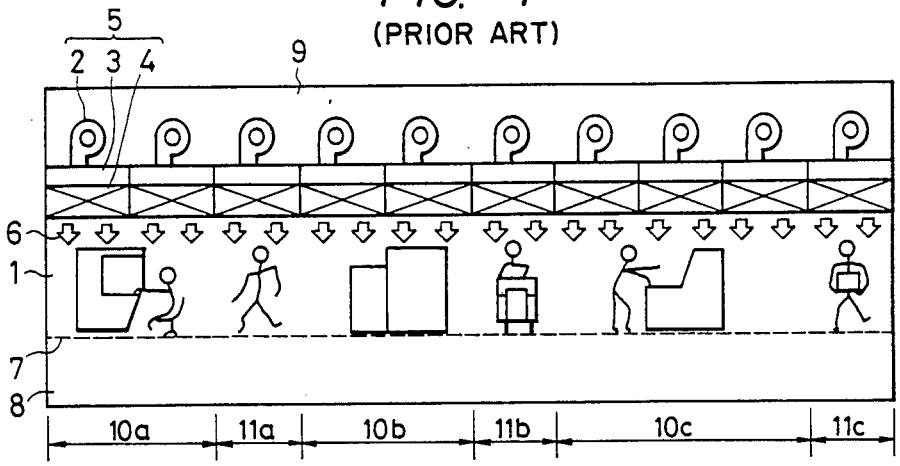
FIG. 1 (PRIOR ART)
FIGS. 1, 2, and 3 are schematic side views of a clean room constructed in accordance with the prior art.
Figure 2:
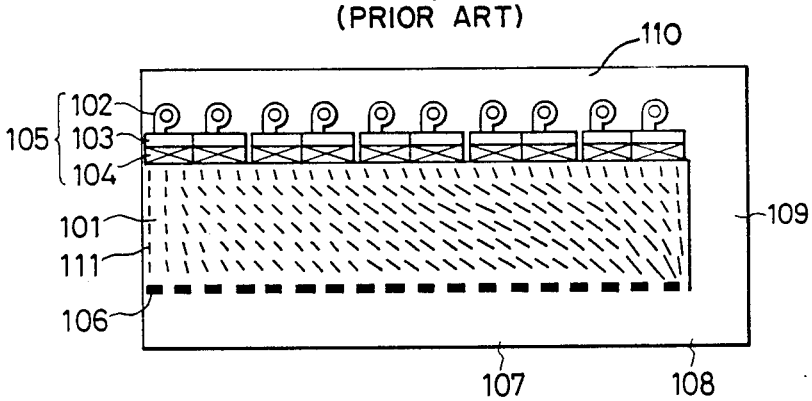
FIG. 2 (PRIOR ART)
Figure 3:
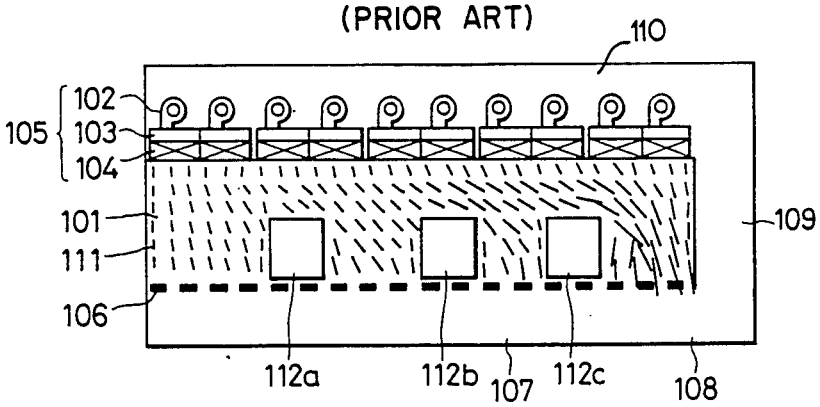
FIG. 3 (PRIOR ART)

Referring now to the drawings wherein like reference numerals are used throughout the various views to designate like parts and, more particularly, to FIGS. 1–3, according to these figures, generally, a clean room 1 is divided into wafer handling areas 10*a*, 10*b*, 10*c* where equipment is accommodated, and aisle areas or maintenance areas 11*a*, 11*b* and 11*c* where operators as walk or convey chemicals, with the air flow rate 6 of clean air to each of the divided areas being the same.

More particularly, clean air is blown out from a filter unit 5 which includes a fan unit 2, a high pressure chamber 3, and a HPEA filter 4 into the clean room 1 and an air flow rate 6, and this air is discharged from a floor 7 having openings to a duct 8 beneath the floor and further introduced to a duct 9 in the ceiling through a duct provided, for example, interiorly of the wall, then, again through the fan unit 2, high pressure chamber 3, and filter 4 so as to be supplied to the clean room 1 as clean air when this recirculation is performed, the air flow rate at which the clean air is blown out is usually regulated to be substantially uniform over the whole extent and about 0.3–0.5 m/s is selected as the air flow rate 6.

As shown in FIG. 2, in the ceiling of a superclean space 101, filter units 105 comprising a fan unit 102, high pressure chamber 103, and HEPA filter 104 are provided substantially over the whole extent, and the floor is covered with a floor board 106, having lattice-shaped openings, and air blown out from the HEPA filters 104 passes through the openings of the floor board 106 after passing through the room, and then flows through a duct 107 under the floor to an air return 108, up in a wall duct 109 to be led to a duct 110 in the ceiling, and it is cleaned during further passing through the fan units 102, high pressure chambers 103, and HEPA filters 104 and blown out again into the superclean space 101. The dashed line 111 indicates the direction and velocity of the clean air flow at each point.

As readily apparent from FIG. 2, air passing through the openings of the floor 106 converges upon the openings near the return 108 and does not pass at a uniform air flow rate over the entire floor area. For this reason, air flow in the entire room is directed to the right lower portion of FIG. 2 and, more particularly, in a central portion of the room, the air flows almost laterally and does not form a "down" flow. This means that when dust is generated at a point in the room which is remote from the return 108, the dust does not flow downwardly vertically to be discharged under the floor but rather flows horizontally and diffuses extensively thereby contaminating the super clean space.

Moreover, FIG. 3 schematically depicts the direction and velocity of clean air in a state more similar to actual manufacturing conditions wherein the apparatus 112*a*–112*c* employed for manufacturing and inspection are arranged in the clean room. As apparent from FIG. 3, in the clean room, air flow is such so as to converge upon the openings in the right lower portion of the floor, and the lateral flow is considerably greater above the apparatus 112*a*–112*c* whereby it is difficult to prevent the dust or contamination from diffusing.

Figure 4:
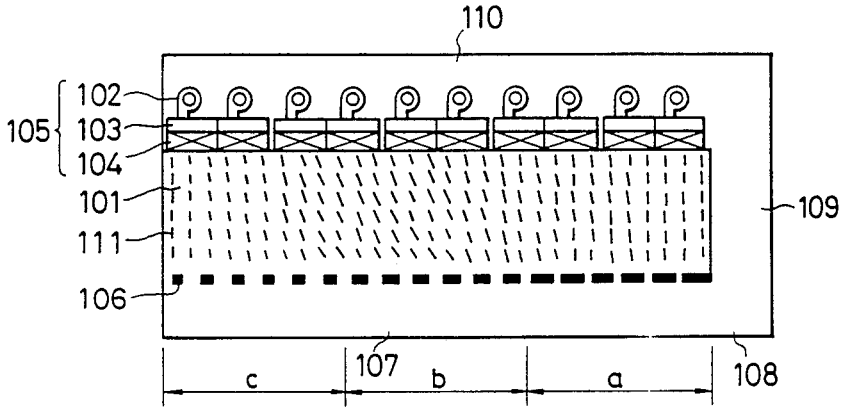
FIGS. 4–8 are sectional schematic views of a clean room constructed in accordance with respective embodiments of the present invention.

In accordance with the present invention as shown in to FIG. 4, the opening rate of the floor board in an area "a" near to the air return 108 is set to 10%, and the opening rate of the floor board in an area "b" is set to 33%, and the opening rate of the floor board in an area "c" farthest from the air return 108 is set to 67%. The areas "a", "b" and "c" were made substantially equal and, as a result, the air flow was greatly improved, as shown by a short line 111, as compared with the case of the prior clean room which was depicted in FIG. 2. Namely, the convergence of air flow upon the portion near to the air return was largely reduced, and lateral air flows almost disappeared and a substantially vertical air flow was provided thereby realizing a down flow.

Figure 5:
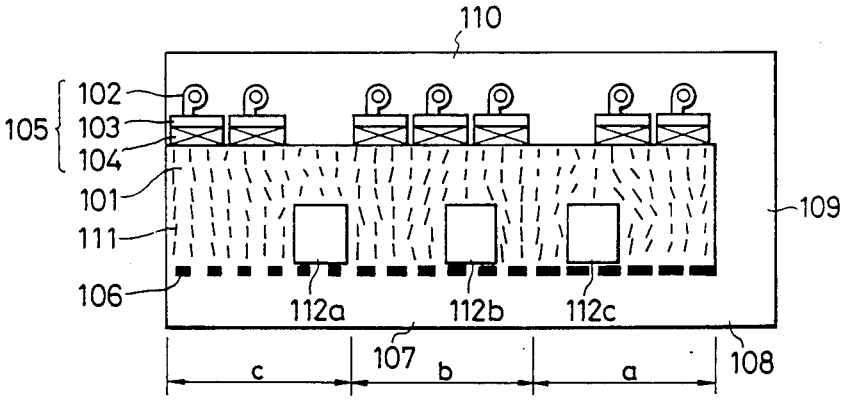

As shown in FIG. 5 as with FIG. 4, the opening rates of the floor board were classified for an area "a", area "b" and area "c" in sequence from the position of the air return 108 and set to 10%, 33% and 67%, respectively. Further, as shown in FIG. 5, apparatuses 112*a*, 112*b* and 112*c* were disposed and the air flow state in the room was measured. The HEPA filters in the ceiling were partly removed as shown in FIG. 5. The air flow under this condition, as shown by a short line 111, was improved in the integrity of laminar down flow as compared with the prior clean room shown in FIG. 3, and the air flow was not excessively lateral above the apparatus 112*a*, 112*b* and 112*c*, and it was recognized to be a very fine state in which dust is difficult to diffuse.

Figure 6:
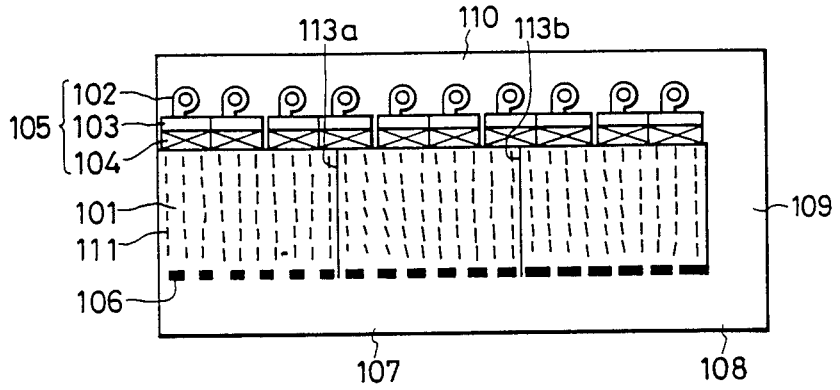

In the embodiment of FIG. 6, partition walls 113*a* and 113*b* are provided in the room, whereby the integrity of laminar down flow was improved, and the direction of the air flow was further improved by providing the partition walls.

Figure 7:
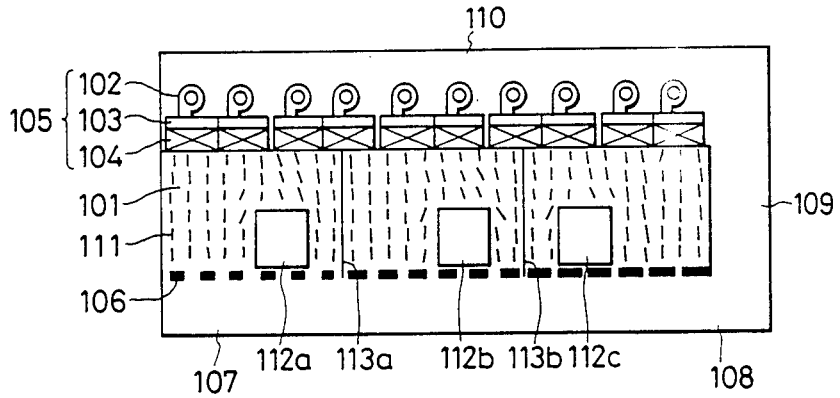

The embodiment of FIG. 7 shows the air flow state in a condition wherein the apparatus 112a, 112b and 112c are placed in the clean room in the manner described above in connection with FIG. 6. It was recognized that the integrity of laminar down flow was made more favorable by providing the partition walls 113a and 113b. It is apparent that this favorable result was obtained by making the opening rate of the floor board different according to the portions as mentioned above.

Figure 8:
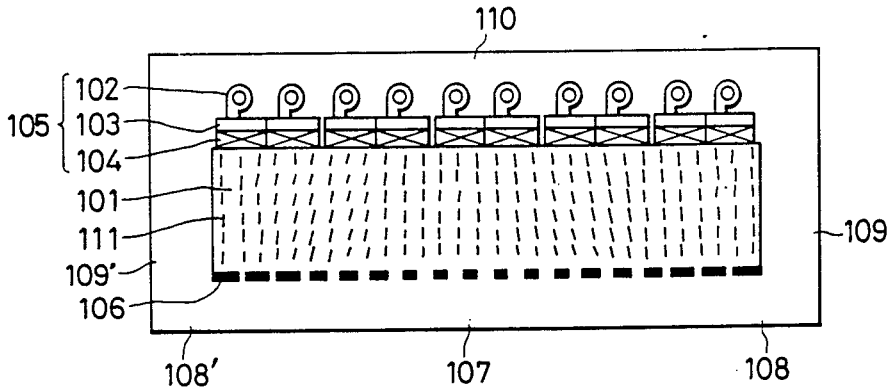

In FIG. 8, the air return 108 is also provided at the opposite position 108', and, accordingly, a wall duct 109' is provided in addition to 109 so that air also returns to the ceiling therethrough. As shown in FIG. 8, the opening rates of the floor board in the areas nearest to the air returns 108 and 108' were set to 10%, the smallest value, and 33% in the intermediate areas, and the opening rate of the central area that is farthest from the air returns 108 and 108' was set to 67%. With the arrangement of FIG. 8, a very fine or improved air flow distribution is obtained.

Additionally of the above described embodiments, in each the opening rates of the floor board were selected in three steps of 10%, 33% and 67%, but it was certain that, if the opening rates are set to 5–20%, 25–45% and 50–70%, respectively, in sequence from the side near to the under-floor air return to achieve the object of the present invention without being limited to the above-mentioned values, a favorable result can be obtained. If the opening rate of the side nearest to the under-floor return is set to a value greater than 20%, the integrity of laminar down flow is not remarkably improved, so it is more preferable to set the opening rate to 20% or less.

Further, in the above above described embodiments, description has been made to the examples in which the opening rates are selected in three steps, but it is also effective if the opening rates are selected in two steps, and, as apparent, it is surely effective if the opening rates are selected in four or more steps.

Figure 9A:
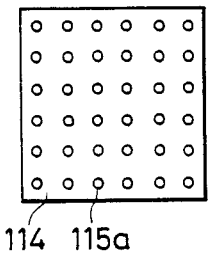
FIGS. 9*a*–9*c* are schematic plan views of a floor having different opening rates in accordance with the present invention.
Figure 9B:
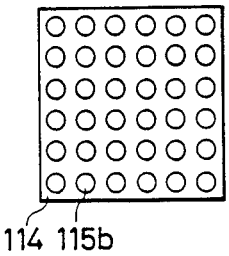
Figure 9C:
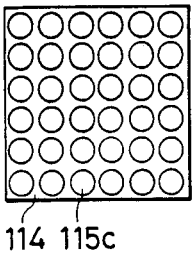
Figure 10A:
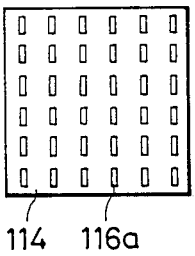
FIGS. 10*a*–10*c* are plan views showing floors in accordance with the present invention also having different opening rates.
Figure 10B:
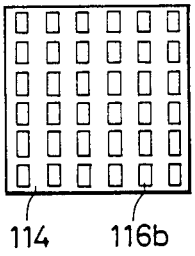
Figure 10C:
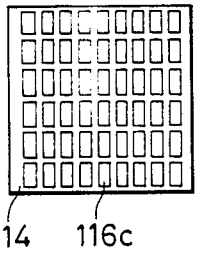

Constructing the floor board having different opening rates can be realized in the following way, for example. More particularly, as shown in FIGS. 9*a*–9*c*, it can be realized by changing the sizes of the openings provided in the floor board so as to be 115*a*, 115*b* and 115*c* or as shown in FIGS. 10*a*–10*c*, it can also be realized be shaping the openings 116*a*–116*c* into rectangles and changing the length of the long or short side of each rectangular opening.

As another way which is as effective as adjustment of the opening rate of the floor board as mentioned above, it can also be adopted that, beneath the floor having openings, a slidable board having other openings is provided so that they are placed one above the other, and that the slidable board is slid horizontally so as to change the overlap of both openings to thereby adjust the opening area.

As still another way, an effect similar to that obtained by changing the opening area can also be obtained by placing coarse filters beneath the floor having openings to increase the resistance of the air flow passing through the openings.

Figure 11:
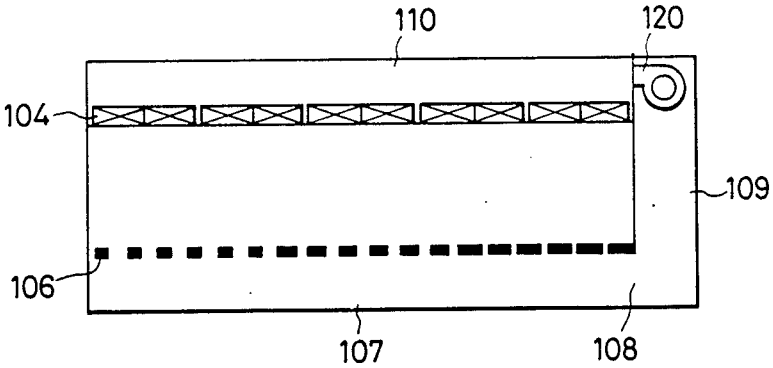
FIG. 11 is a schematic view of a clean room constructed in accordance with another embodiment of the present invention.

In the above embodiments as shown in FIGS. 4–8, examples have been provided to the method in which the mechanism for blowing clean air comprises a so-called filter unit having a fan unit, high pressure chamber and filter integrated therein. However, the object of the present invention can also be surely achieved in the method in which a fan unit 120 supplying air to all of the filters is provided at the position through which the returned air enters the ceiling, as shown in FIG. 11. In this case, the space in the ceiling 110 constitutes a high pressure chamber.

In each embodiment above, the air flow rate for blowing clean air was set to 0.35 m/s.

Figure 12:
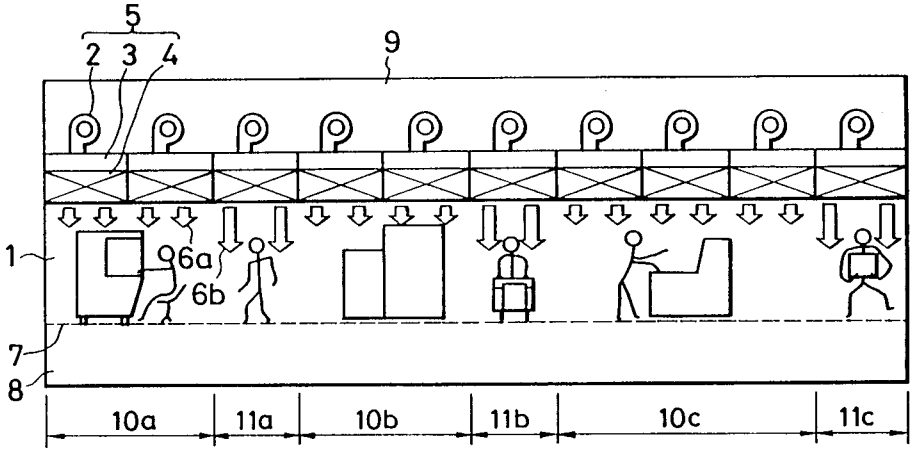
FIG. 12 is a schematic view of a clean room constructed in accordance with a further embodiment of the present invention.

In the embodiment of FIG. 12, the construction of the clean room is the same as shown in FIG. 1, but the air flow rate for blowing from the filters was set to 6*a* for the wafer handling areas and 6*b* larger than 6*a* for the aisle areas. In FIG. 12, the air flow rate 6*a* was set to 0.35 m/s, and the air flow rate 6*b* was set to 0.5, 0.7 and 1.0 m/s.

The effect due to the differences between the air flow rates will be explained on the basis of a result of the actual measurement.

Figure 13:
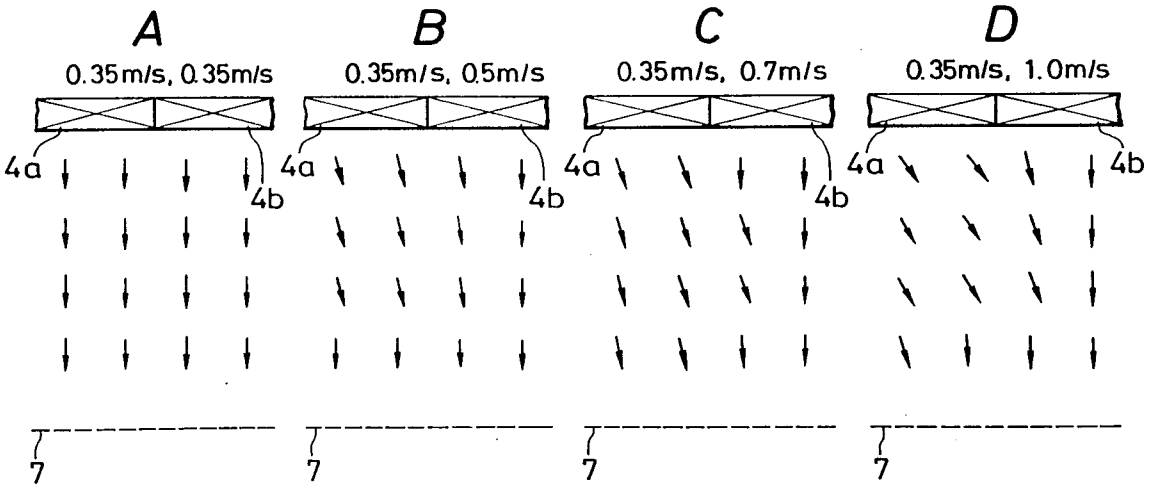
FIG. 13 is a diagrammatic illustration of an air flow rate in a space in which the areas of various air flow rates are adjacent to each other.

FIG. 13 shows the directions of the air flows from adjacent filters 4*a* and 4*b* with each arrow indicating the direction of each air flow rate. Above each of the filters 4*a* and 4*b*, the air flow rate is indicated. "A" shows the case that both filters 4*a* and 4*b* are provided with an equal air flow rate of 0.35 m/s, and the air flows have no directional bias and are directed vertically downwards. "B"–"D" show the cases that there is a difference between the air flow rates as shown in FIG. 13, and as to the air flow direction, it was recognized that air at the lower air flow rate side was directing to the higher air flow rate side in the all cases. Namely, air at the lower air flow rate side is attracted to the higher are flow rate side, but the reverse of that was not recognized. In FIG. 13, a numeral 7 designates a floor board having openings.

Figure 14:
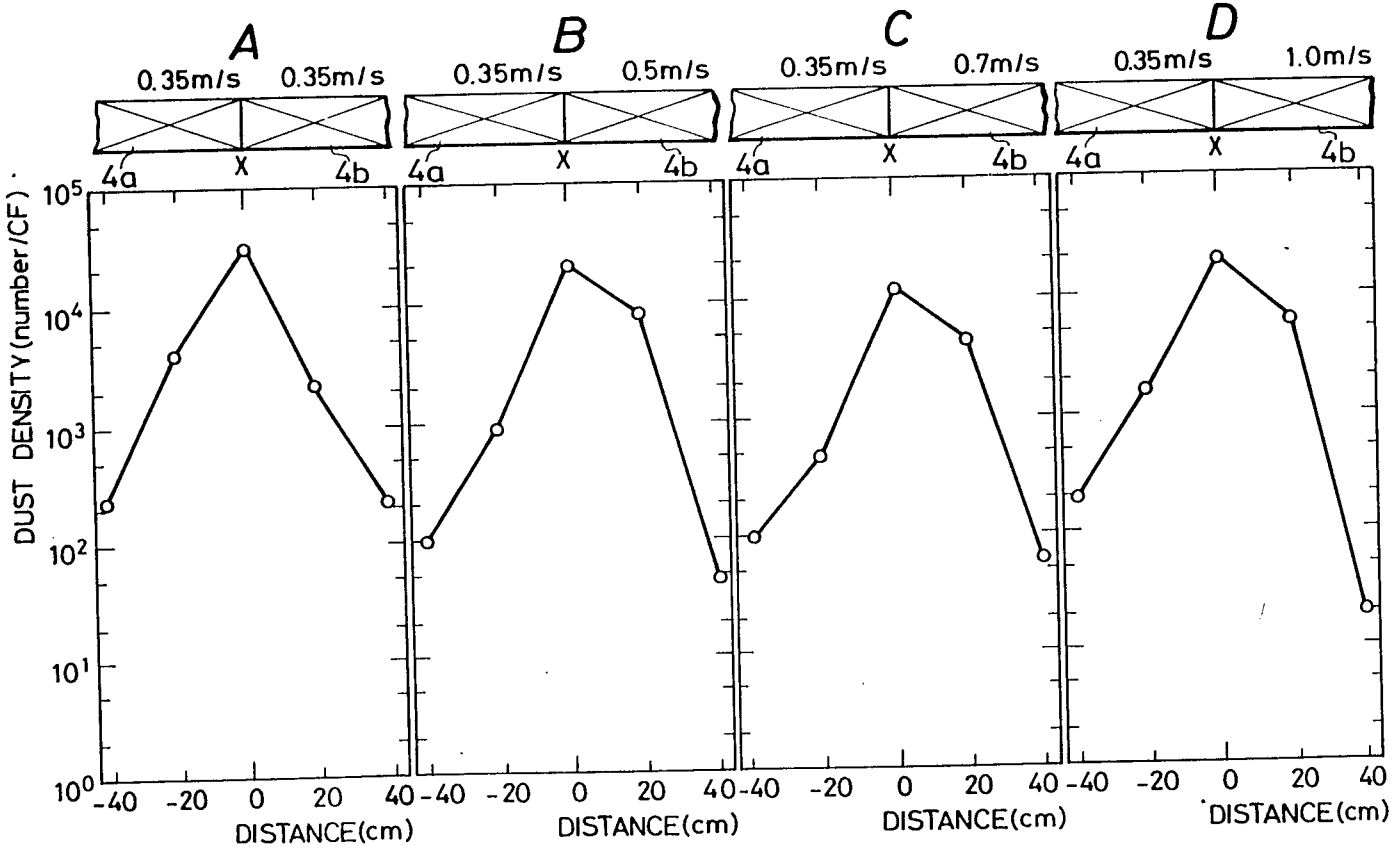
FIGS. 14 and 15 are graphical illustrations depicting a distribution of dust in a space in which the areas of various air flow rates are adjacent to each other.

FIG. 14 shows a result of the dust distribution measurements which were carried out by placing a dust generator directly under the boundary between the adjacent filters and generating dust for five seconds, then, after the elapse of one minute, counting the dust at the position one meter below. It was determined that the dust diffused symmetrically for the case "A" in which there was no difference between the air flow rates, but it was determined that, in the cases "B"–"D'-'in which a difference was provided between the air flow rates, the dust diffused on the bias to the higher air flow rate side and the dust density in the lower air flow rate side was lower.

In FIG. 14 and also in later described FIG. 15, a symbol "X" designates the dust generating position, and above each of the filters 4*a* and 4*b*, the air flow rate for blowing air is described. In addition, the axes of abscissa in FIGS. 14 and 15 represent the distance (cm) from the boundary between the adjacent filters, and the axes of ordinate represent the density of dusts having a size larger than 0.5 μm (the number of dusts per one cubic foot).

Figure 15:
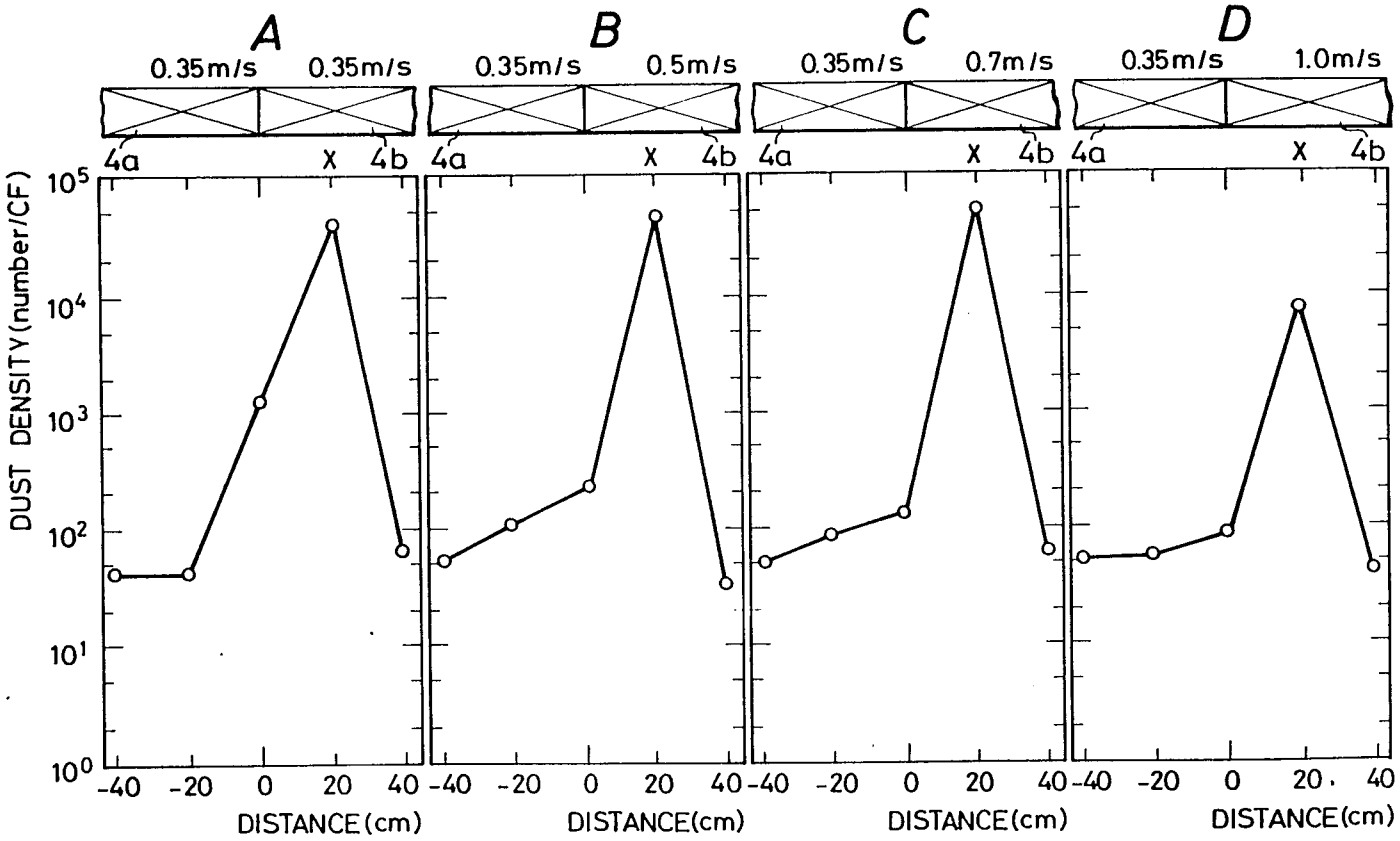

Further, FIG. 15 shows the state which was seen after dust were generated at a position 20 cm away from the boundary between the adjacent filters into the higher air flow rate side. In the case "A" in which no difference was provided between the air flow rates, dust diffused to the vicinity of the boundary, but in the cases "B"–"D" in which a difference was provided between the air flow rates, dust was rarely seen to diffuse from the vicinity of the boundary to the lower air flow rate side.

When the air flow rate for blowing clean air in the wafer handling areas was set to 0.35 m/s and the air flow rate for blowing clean air in the aisle areas was set to 0.7 m/s in the clean room shown in FIG. 4, the dust generated in the aisle areas scarecely diffused into the wafer handling areas, and a very preferable result was obtained.

As mentioned above, by making the opening rate of the floor board smaller in the area near to the air return under the floor and larger in the area remote from the air return, the air flow in the clean room can be made to form substantially down flow, by which the diffusion of dust can be prevented and the improvement of the yield and reliability of the products is realized. In addtion, even if there are provided portions at which no filter is mounted, substantially ideal down flow can be obtained, thereby bringing about energy saving and good economy.

Further, to prevent the dust generated in the aisle areas from diffusing into the wafer handling areas which need to be kept clean, it is greatly effective that the air flow rate in the aisle areas is made larger relative to the air flow rate in the wafer handling areas, by which the yield and reliability of the products can be improved. In this case, that can be achieved only by adjusting the air flow rate for blowing out air from the filters without adding particlar facilities or equipment, so it is advantageous also in the point of economy.

Moveover, by setting the air flow rate of the aisle areas larger relative to the air flow rate of the wafer handling areas as well as setting the opening rate of the floor board smaller in the area near to the air return under the floor and larger in the area remote from the air reutrn, the dust density of the wafer handling areas can be kept extremely low.

What is claimed is:

1. A clean room comprising an upper portion, a floor means provided with a plurality of openings, filter means provided in said upper portion, means for blowing clean air through said filter means to the floor means and discharging the clean air through the openings, and air return means for returning air discharged through the openings to the blowing means so as to enable blowing the clean air through said filter means to the floor means, the clean room including aisle areas where dust is generated and wafer handling areas into which dust diffuses, and wherein said means for blocking is adapted to provide an air flow rate of said clean air in the aisle which is larger than an air flow rate in the wafer handling areas whereby dust diffusion into the wafer handling areas is reduced.

2. A clean room as claimed in claim 1, wherein an opening rate of said floor means is less in a portion thereof near to the air return means than in a portion remote from said air return means.

3. A clean room as claimed in claim 2, wherein the opening rate in a portion near to said air return means is not greater than 20%.

4. A clean room as claimed in claim 2, wherein said opening rate of the floor means is 5–20% in the portion near to said air return means, 25–45% in an adjacent portion, and 50–70% in a portion farthest from said air return means.

5. A clean room according to claim 2, wherein said air return means is disposed below said floor means.

6. A clean room according to claim 1, wherein the air flow rate in the wafer handling areas is 0.25–0.50 m/s and the air flow rate in the aisle areas os 0.50–1.00 m/s.

7. A clean room according to claim 1, wherein the air flow rate in the wafer handling areas is around 0.35 m/s and the air flow rate in the aisle areas is around 0.70 m/s.

8. In a clean room comprising means for blowing out clean air obtained through filters from the upper portion of said clean room to the floor, discharging it through openings in the floor, and blowing it again through said filters from an upper portion of said clean room to the floor, a clean room wherein an air flow rate of said clean air in aisle areas where dust is generated is larger than an air flow rate in wafer handling areas into which dust diffuses, whereby dust diffusion into the wafer handling areas is reduced, and wherein the air flow rate in the wafer handling areas is 0.25–0.50 m/s and the air flow rate in the aisle areas is 0.50–1.00 m/s.

9. A clean room comprising means for blowing out clean air obtained through filters from an upper portion of said clean room to the floor, discharging it through openings in the floor, and blowing it again through said filters from the upper portion of said clean room to the floor, a clean room wherein an air flow rate of said clean air in aisle areas where dust is generated is larger than an air flow rate in wafer handling areas into which dust diffuses, and wherein ther air flow rate in the wafer handling areas is around 0.35 m/s and the air flow rate in the aisle areas is around 0.70 m/s, whereby dust diffusion into the wafer handling areas is reduced.

10. A clean room comprising an upper portion a floor means provided with a plurality of openings, filter means provided in said upper portion, means for blowing clean air through said filter means to the floor means and discharging the clean air through the plurality of openings in the floor means, and a return means for returning the air discharged through the openings to the blowing means so as to enable a blowing of the clean air through said filter means to the floor means, and wherein an opening rate of said floor means is less in a portion near to the air return means than in a portion remote from said air return means.

11. The clean room as claimed in claim 10 wherein the opening rate of the floor in the portion near to said air return means is not greater than 20%.

12. The clean room as claimed in claim 10 wherein said opening rate of the floor is 5–20% in the portion nearest to said air return means, 25–45% in an adjacent portion, and 50–70% in portion farthest from said air return means.

13. A clean room according to claim 10, wherein said air return means is disposed below said floor means.

14. A clean room as claimed in claim 10, wherein the opening rate of the floor means in the portion near to said air return means is not greater than 20%.

15. A clean room as claimed in claim 10, wherein the opening rate of the floor means is 5–20% in the portion nearest to said air return means, 25–45% in an adjacent portion, and 50–70% in a portion farthest from said air return means.

* * * * *